US008110779B2

(12) United States Patent
Kishimoto

(10) Patent No.: US 8,110,779 B2
(45) Date of Patent: Feb. 7, 2012

(54) DOOR LOCK CONTROL DEVICE IN HEATING COOKER

(75) Inventor: Masamitsu Kishimoto, Matsubara (JP)

(73) Assignee: Sharp Kabushiki Kaisha, Osaka (JP)

( * ) Notice: Subject to any disclaimer, the term of this patent is extended or adjusted under 35 U.S.C. 154(b) by 1104 days.

(21) Appl. No.: 11/947,289

(22) Filed: Nov. 29, 2007

(65) Prior Publication Data

US 2009/0139286 A1 Jun. 4, 2009

(51) Int. Cl.
*F24C 15/02* (2006.01)

(52) U.S. Cl. ..... 219/391; 219/413; 219/414; 219/507; 219/510; 126/197

(58) Field of Classification Search ..... None
See application file for complete search history.

(56) References Cited

U.S. PATENT DOCUMENTS

| | | | | | |
|---|---|---|---|---|---|
| RE27,545 | E | * | 1/1973 | Guy | 219/412 |
| 4,082,078 | A | * | 4/1978 | Thuleen et al. | 126/197 |
| 4,374,320 | A | * | 2/1983 | Barnett | 219/413 |
| 4,922,081 | A | * | 5/1990 | Kadwell et al. | 219/506 |
| 5,705,792 | A | * | 1/1998 | Graham | 219/497 |
| 6,930,284 | B2 | * | 8/2005 | Kang | 219/391 |
| 7,137,387 | B2 | * | 11/2006 | Edwards et al. | 126/190 |
| 2005/0284464 | A1 | * | 12/2005 | Edwards et al. | 126/197 |
| 2006/0102166 | A1 | * | 5/2006 | Simmons et al. | 126/197 |

FOREIGN PATENT DOCUMENTS

| | | | | |
|---|---|---|---|---|
| DE | 3039273 | A | * | 5/1982 |
| JP | 54-79546 | U | | 6/1979 |
| JP | 3-13730 | A | | 1/1991 |
| JP | 3-45820 | A | | 2/1991 |
| JP | 11-237053 | A | | 8/1999 |

OTHER PUBLICATIONS

DE-3039273 A, partial English translation.*

* cited by examiner

*Primary Examiner* — Joseph M Pelham
(74) *Attorney, Agent, or Firm* — Birch, Stewart, Kolasch & Birch, LLP

(57) ABSTRACT

There is provided a door lock control device in a heating cooker that prevents a door from being accidentally unlocked when the door is locked and a temperature inside the heating cooker is a predetermined temperature or more such as during self-cleaning. When the temperature inside the cooker is low and a thermal switch 8 of a lock detection and thermal switch portion 6 is closed, the lock detection and thermal switch portion 6 can be energized, and a power supply line 2 can supply power to a drive motor 5 to lock and unlock the door. In the case of self-cleaning or the like, the door is locked and a detection switch 7 is on a door lock side 7*a*, but the temperature inside the cooker is high and thus the thermal switch 8 is opened, and the power supply line 2 is interrupted.

4 Claims, 5 Drawing Sheets

DOOR LOCK CONTROL DEVICE IN HEATING COOKER

The present application is based on Japanese patent application No. 2006-276458 filed on Oct. 10, 2006, the entire contents of which are hereby incorporated by reference.

BACKGROUND OF THE INVENTION

1. Field of the Invention

The present invention relates to a door lock control device that can lock and unlock a door by an operation of a drive motor in a heating cooker.

2. Description of the Related Art

A drawer type heating cooker has been proposed in which a drawer, on which an object to be heated can be placed, can be drawn together with an open/close door from a cooker body, and an opening of a heating chamber is closed by the open/close door when the drawer is housed in the heating chamber in the cooker body (Japanese Patent Laid-Open Publication No. 3-45820 (page 2, lower left column, line 6 to page 3, upper right column, line 16, FIGS. 1 to 4, and Japanese Patent Laid-Open Publication No. 11-237053 (paragraphs [0029] to [0032], FIG. 1)). Such a drawer type heating cooker includes an apparatus body (a cooker body) having a cooking chamber (heating chamber) that can house an object to be heated, an open/close door that cuts off the cooking chamber from outside air, and a bottom plate or a heating container (drawer) that interlocks with the open/close door and on which an object to be cooked can be placed. More specifically, the bottom plate or the heating container is smoothly slid by a slide mechanism, and a rotation output of a motor is transmitted to the slide mechanism via conversion means such as a rack and pinion mechanism, thereby allowing the bottom plate or the heating container to be moved in a drawing or housing direction with respect to the apparatus body. In the state where the bottom plate or the heating container is housed in the apparatus body, the open/close door occupies a position for cutting off the cooking chamber from the outside air. In the heating cooker described in Japanese Patent Laid-Open Publication No. 11-237053, a heating container has an opening formed in an upper portion and can be drawn from a cooker body, and the opening is covered with a lid to from a heating chamber for confining microwaves, and a choke groove is provided between an opening peripheral edge of the heating container and the lid to prevent leakage of microwaves.

In a heating cooker such as an electric oven, the inside of the cooker is sometimes cleaned by self-cleaning (burning off inside the cooker) when soiled. The self-cleaning is performed by increasing a temperature inside the cooker and thus performed with a door being locked by a latch device driven by a motor. At this time, the following requirements need to be satisfied for safety. Specifically, it is not allowed that the temperature inside the heating cooker increases to a predetermined temperature (for example, 260° C. or 350° C.) or more until the door is locked. Also, the self-cleaning can be cancelled before the temperature inside the cooker reaches the predetermined temperature, and it is necessary that the door can be immediately unlocked if the door is locked. Further, it is necessary that the door cannot be unlocked until the temperature inside the cooker decreases below the predetermined temperature when the temperature exceeds the predetermined temperature.

In connection to self-cleaning of an electric oven or the like, a door lock device has been proposed in which a lever connected to a motor, a latch lever, and a fixed lever are connected at a locking portion so as to interlock with each other, and a tip of the fixed lever is inserted into a keyhole of a door to lock the door so that the door cannot be opened during the self-cleaning (burning off inside the oven) or when a temperature inside the oven is high (see Japanese Patent Laid-Open Publication No. 3-13730 (page 2, lower left column, line 4 to page 3, upper left column, line 18, FIGS. 1 to 4). Specifically, as shown in FIG. 5, a door 37 is locked by a series of operations such that a motor 22 that is always rotated in a fixed direction rotates a fixed lever 32 interlocking with a motor shaft 23, a tip 35 of the fixed lever 32 is caught in a keyhole 38 formed in the door 37, and the door 37 in which the tip 35 is caught is drawn in a closing direction by a drawing operation of the fixed lever 32. The interlocking structure between the motor shaft 23 and the lever 32 is constituted by a rotating lever 24 mounted to the motor shaft 23, a latch lever 27, and the fixed lever 32, and when the rotating lever 24 is rotated, a locking portion 25 is moved in a movement groove 28, and thus the latch lever 27 is rotated around a locking portion 26, and a movement groove 29 formed in the latch lever 27 engages a locking portion 33 provided in the fixed lever 32 to rotate and draw the fixed lever 32. A groove 34 that the locking portion 33 engages is formed in a mounting plate 21, and a locking portion 31 provided in the mounting plate 21 is locked in a movement groove 36 formed in the fixed lever 32. An actuator 30 attached to the latch lever 27 operates a switch 39, the motor 22 is automatically controlled by the signal from the switch 39 and temperature detection signal from a controller, and stable operations from locking to unlocking the door are performed, thereby preventing a malfunction and reliably closing the door at a high temperature.

A door open/close mechanism of a microwave oven has been also proposed that is configured so that a door is not opened by operating a door opening knob when a cooking switch fails resulting from contact point welding (Japanese Utility Model Publication Laid-Open Publication No. 54-79546 (page 5, line 12 to page 9, line 18). A door hook provided on the door so as to extend into the oven engages a latch hook provided on an oven body to maintain the door in a closed state. A connection lever associated with the door opening knob is connected to a latch lever that operates the latch hook. In the case of the contact point welding of the cooking switch, a structure for preventing rotation of the connection lever is adopted, and thus the latch lever cannot operate the latch hook, thereby preventing the door from opening.

However, for the above described electric oven or the like, if a malfunction of a control device or a failure in a motor driving component occurs, the door is sometimes unlocked though the temperature inside the oven is high, and it is found that such a state causes a dangerous state where a user can open the door.

SUMMARY OF THE INVENTION

Thus, in the case of detecting that a door is locked in a heating cooker such as a microwave oven, there is a need for preventing the door of the heating cooker from being unlocked when a temperature inside the heating cooker is a predetermined temperature or more.

Since a state where a user can open an open/close door of a heating cooker is dangerous when a temperature inside the heating cooker is a predetermined temperature or more such as during self-cleaning, the present invention has an object to provide a door lock control device in a heating cooker that prevents the open/close door from being unlocked, prevents an accidental opening operation of the open/close door, and provides safe handling of the heating cooker.

In order to solve the above described object, the present invention provides a door lock control device in a heating cooker including: a cooker body having a heating chamber formed therein; an open/close door that can close an opening of the heating chamber; a drive motor that drives a lock member for locking the open/close door and switches between a lock position and an unlock position; and a circuit that supplies power to the drive motor, wherein the circuit includes: a detection switch that switches between a lock side and an unlock side according to the lock position and the unlock position occupied by the lock member respectively; and a lock detection and thermal switch portion that is connected in series on the lock side of the detection switch and combined with a thermal switch that is opened according to a temperature inside the heating cooker equal to or higher than a predetermined temperature.

With the door lock control device in the heating cooker, when the temperature inside the cooker is low even if the open/close door is locked, the thermal switch is closed, the lock detection and thermal switch portion can be energized through the detection switch and the closed thermal switch on the lock side, and a power supply line to the drive motor is not interrupted. Thus, power is supplied to the drive motor to operate the drive motor, and thus the lock member that locks the open/close door in a closed state can be driven to unlock the open/close door. Also in a general door unlock state, the lock detection and thermal switch portion can be energized through the detection switch on the unlock side, and the power supply line that supplies power to the drive motor is not interrupted. Thus, the control device can drive the drive motor to lock and then unlock the lock member.

In the door lock control device in the heating cooker, the supply of power to the drive motor is interrupted when the detection switch is on the lock side, the temperature inside the heating cooker is the predetermined temperature or more, and the thermal switch is opened. Specifically, in the case of self-cleaning or the like, the open/close door is locked by the lock member, and the detection switch that switches according to the lock position and the unlock position of the lock member is on the lock side. The temperature inside the heating cooker is considered to be higher than the predetermined temperature set for the thermal switch, and thus the thermal switch connected in series with the detection switch on the lock side is opened, and the power supply line for supplying power to the drive motor is interrupted by the open state of the thermal switch. Thus, in such a power interruption state, even if a malfunction of the control device or a failure in a motor driving component occurs, the drive motor is not energized, and thus the lock member is not driven from the lock state to the unlock state. Thus, in the case of self-cleaning in which opening the open/close door is dangerous, the lock member is not switched to the unlock position, and the open/close door is not accidentally opened.

In the door lock control device in the heating cooker, the lock detection and thermal switch portion may be provided in the power supply line to the drive motor. In this case, energization or interruption of the lock detection and thermal switch portion allows direct control of supply or stop of power to the drive motor.

In the door lock control device in the heating cooker, the lock detection and thermal switch portion may be provided in a relay power supply line that drives the power supply line to the drive motor via a relay. In this case, energization or interruption of the lock detection and thermal switch portion causes energization or interruption of the relay power supply line, and thus causes energization or interruption of the power supply line to the drive motor by driving or non-driving of the relay, thereby allowing indirect control of supply or stop of power to the drive motor.

The door lock control device in the heating cooker according to the present invention is configured as described above, and thus when the open/close door is locked by the lock member and the temperature inside the heating cooker is high, energization to the drive motor that drives the lock member that locks the open/close door is interrupted by the opened thermal switch, and it is prevented that the drive motor unintentionally drives the lock member resulting from a malfunction of the control device or a failure in the motor driving component to switch the lock member from the lock position to the unlock position. Thus, a dangerous state where a user accidentally opens the open/close door though the temperature inside the cooker is high can be avoided to increase safety in handling the open/close door of the heating cooker.

DETAILED DESCRIPTION OF THE INVENTION

Figure 1:
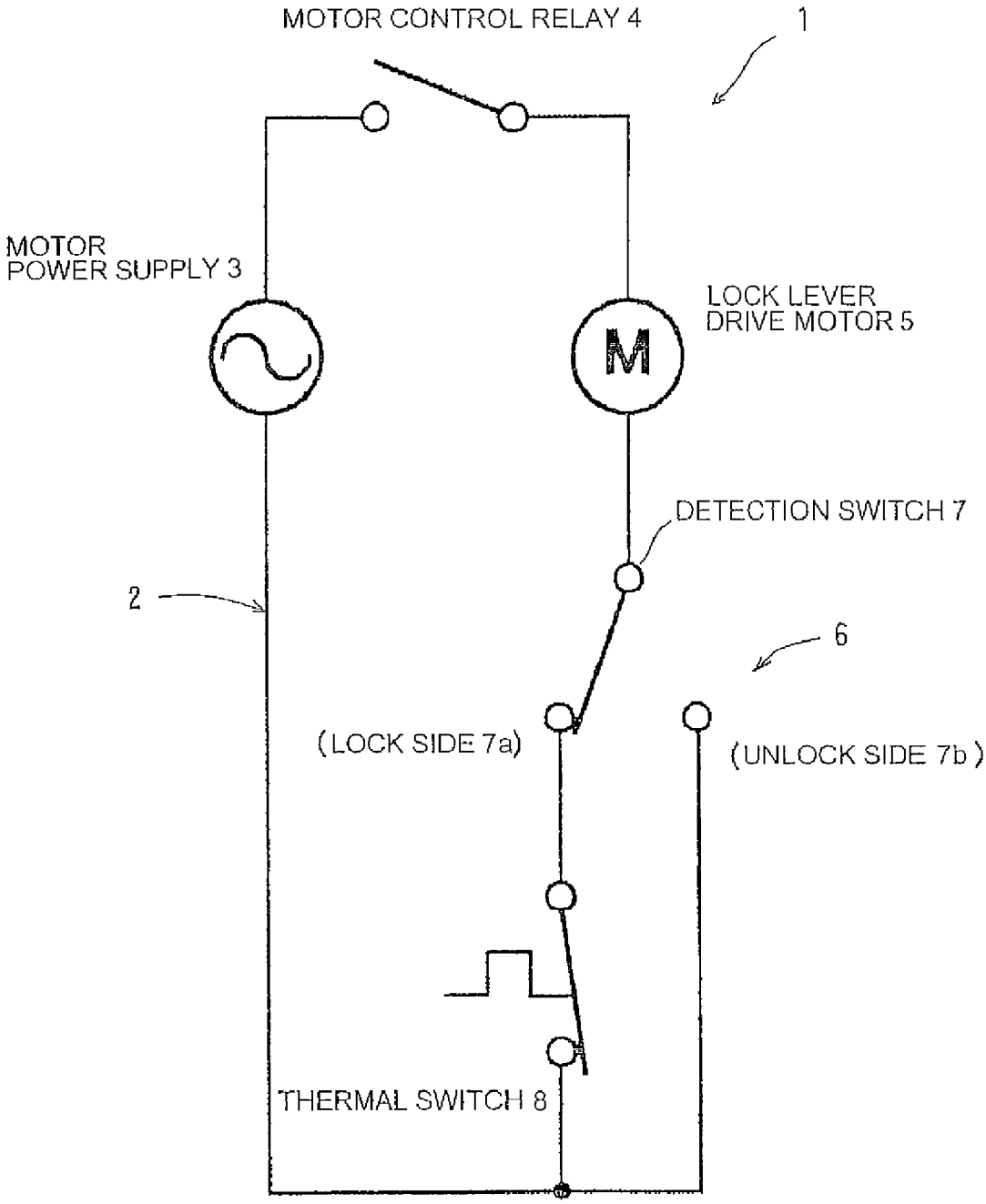
FIG. 1 is a schematic circuit diagram of an embodiment of a door lock control device in a heating cooker according to the present invention.

Now, an embodiment of a door lock control device in a heating cooker (hereinafter abbreviated as a door lock control device) according to the present invention will be described with reference to the accompanying drawings. FIG. 1 is a schematic circuit diagram of an embodiment of the door lock control device according to the present invention. A lock/unlock mechanism of an open/close door of the heating cooker may have a conventional structure including a lock member described with reference to FIG. 3, and a repeated description thereof will be omitted.

In the door lock control device 1 in FIG. 1, for the open/close door (hereinafter simply referred to as a door) for opening and closing an opening of a heating chamber formed in a cooker body, a detection switch 7 for detecting an operation position of a lock member that places the door in a lock state or an unlock state is connected to a drive motor power supply line (hereinafter abbreviated as a power supply line) 2. Specifically, in the door lock control device 1, a motor power supply 3 supplies power to a drive motor 5 for driving the lock member through a motor control relay 4 and a power supply line 2 (hereinafter referred to as a drive motor for simplicity). A lock detection and thermal switch portion 6 is connected in series with the drive motor 5.

The lock detection and thermal switch portion 6 includes the detection switch 7 that can switch between a lock side 7*a* and an unlock side 7*b* according to a lock position occupied by a lock member that locks the door or an unlock position, and a thermal switch 8 connected in series on the door lock side of the detection switch 7. The lock side 7*a* and the unlock side 7*b* of the detection switch 7 correspond to operation positions of a lock lever as the lock member that can lock the door in a closed state, for example, in a lock mechanism of an open/close door in FIG. 3, a lock position where a tip of a series of levers corresponding to the lock member engages a keyhole of a door to lock the door, and an unlock position where a hook of the lever is disengaged from the keyhole to unlock the door.

When self-cleaning or the like is started, the door of the heating cooker is locked in the closed state, and it is necessary to prevent a user from accidentally opening the door. When the door is locked, the detection switch 7 is on the lock side 7*a*. On the lock side 7*a* of the detection switch 7, the thermal switch 8 is connected in series with the motor power supply 3. Thus, only when the door is locked, the function (on/off) of the thermal switch 8 is effective.

If the temperature inside the heating cooker exceeds a predetermined temperature set for the thermal switch 8, the thermal switch 8 is opened (off), and the supply of power to the drive motor 5 through the power supply line 2 is interrupted. Thus, even if a malfunction of the control device or a failure in a drive motor driving component occurs, the drive motor 5 is not energized, and thus it is prevented that the drive motor 5 is operated to drive the lock lever to unlock the door.

When the temperature inside the heating cooker is below the predetermined temperature set for the thermal switch 8, the thermal switch 8 is closed (on), and the power can be supplied to the drive motor 5 through the power supply line 2, and thus the drive motor 5 can be operated to drive the lock lever to unlock the door.

In a general door unlock state, the detection switch 7 is switched to the unlock side 7*b*, and thus the motor power supply 3 can supply power to the drive motor 5 by a circuit through the detection switch 7 and the power supply line 2, and the drive motor 5 can be driven according to the motor control relay 4 being turned on to unlock the door.

Figure 2:
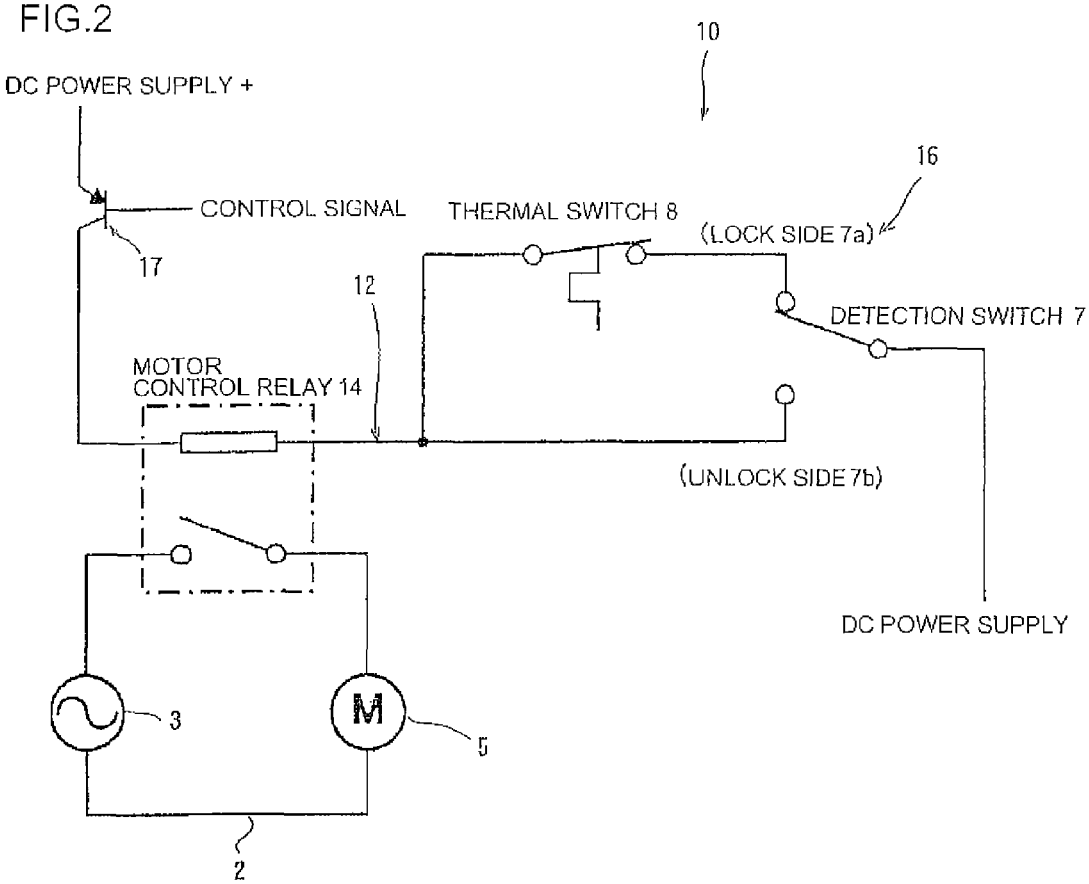
FIG. 2 is a schematic circuit diagram of another embodiment of a door lock control device in a heating cooker according to the present invention.

FIG. 2 is a schematic circuit diagram of another embodiment of a door lock control device in a heating cooker according to the present invention. In the door lock control device 10 in FIG. 2, the same components as in the door lock control device in FIG. 1 are denoted by the same reference numerals, and repeated descriptions thereof will be omitted. In the door lock control device 10, a lock detection and thermal switch portion 16 is connected to a motor control relay power supply line (hereinafter referred to as a relay power supply line) 12 for supplying power to a drive motor 5 for driving a lock lever. Specifically, a motor power supply 3 supplies power to the drive motor 5 through a motor control relay 14. The drive motor 5 is connected to the power supply line 2, while the lock detection and thermal switch portion 16 is provided in the relay power supply line 12 for operating the motor control relay 14.

In the relay power supply line 12, a transistor 17 is connected to a positive side of a DC power supply, and a control signal is input to a base of the transistor 17. The motor control relay 14 is connected to a collector side of the transistor 17, and the lock detection and thermal switch portion 16 is connected between the motor control relay 14 and a negative side of the DC power supply. As in the lock detection and thermal switch portion 6 in FIG. 1, in the lock detection and thermal switch portion 16, an unlock side 7*a* and a lock side 7*b* of the detection switch 7 are connected in parallel with the motor control relay 14, the unlock side 7*b* is directly connected to the motor control relay 14, and the lock side 7*a* is connected to the motor control relay 14 via a thermal switch 8.

When an operation for increasing a temperature inside the heating cooker such as self-cleaning is started, the door of the heating cooker needs to be locked in a closed state. When the door is locked, the detection switch 7 is on the lock side 7*a*. The function (on/off) of the thermal switch 8 is effective only when the door is locked.

If the temperature inside the heating cooker exceeds a predetermined temperature set for the thermal switch 8, the thermal switch 8 is opened (off), and the power supply line 12 to the motor control relay 14 is interrupted. Thus, even if a malfunction of the control device or a failure in a drive motor driving component occurs, the drive motor 5 is not energized, and thus it is prevented that the drive motor 5 is operated to unintentionally unlock the door.

When the temperature inside the heating cooker is below the predetermined temperature set for the thermal switch 8, the thermal switch 8 is closed (on), and power can be supplied to the motor control relay 14 through the power supply line 12. Thus, the transistor 17 is driven by a control signal to supply power to the motor control relay 14, and thus the drive motor 5 can be operated to drive the lock lever to unlock the door.

In a general door unlock state, the detection switch 7 is switched to the unlock side 7*b*, and thus the transistor 17 is driven by the control signal to energize the power supply line 12 to turn on the motor control relay 14, and thus the motor control relay 14 can turn on the power supply line 12 to supply power to the drive motor 5. Thus, the drive motor 5 can be operated to unlock the door.

In the case of a failure in the thermal switch 8, a serviceman can access the thermal switch 8. The thermal switch 8 in failure may be bypassed.

Figure 3:
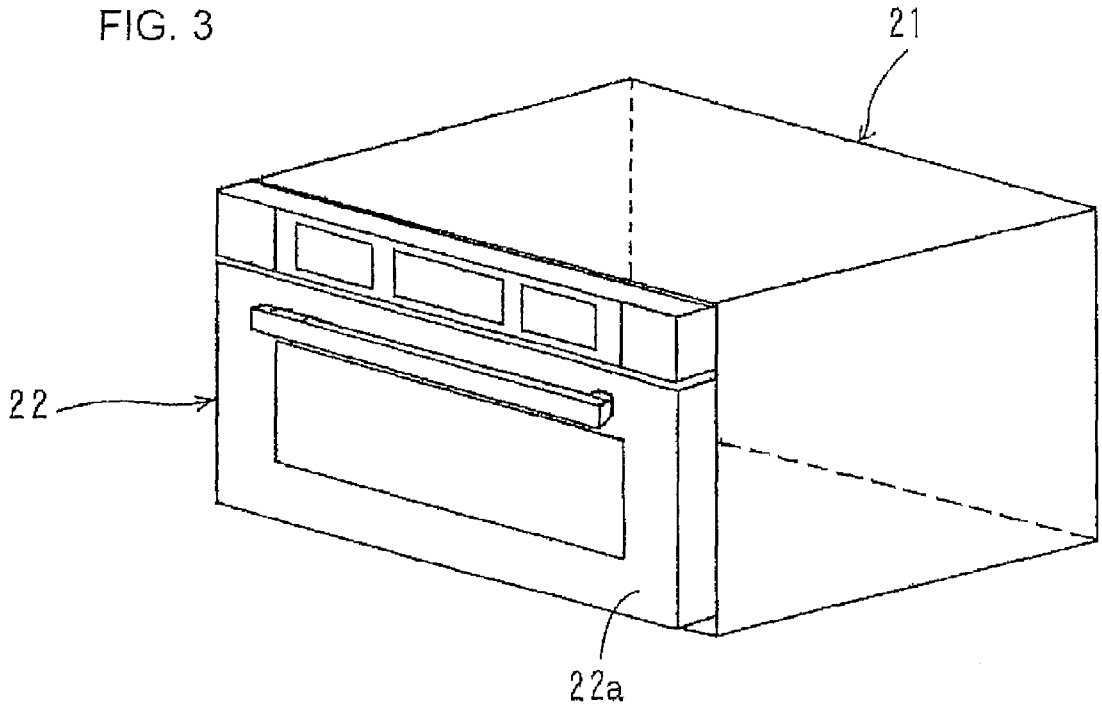
FIG. 3 is a cross-sectional side view of the drawer-type heating cooker.
Figure 4:
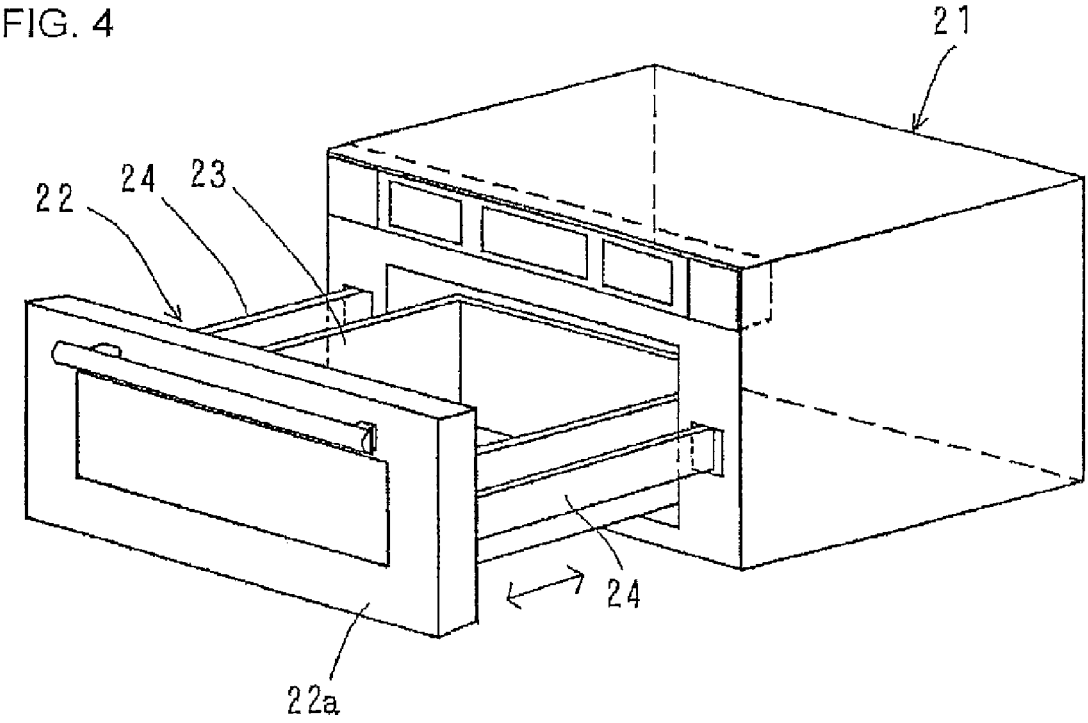
FIG. 4 is a control block diagram relating to the driving of the opening and closing door and warning sounds in a drawer-type heating cooker.
Figure 5:
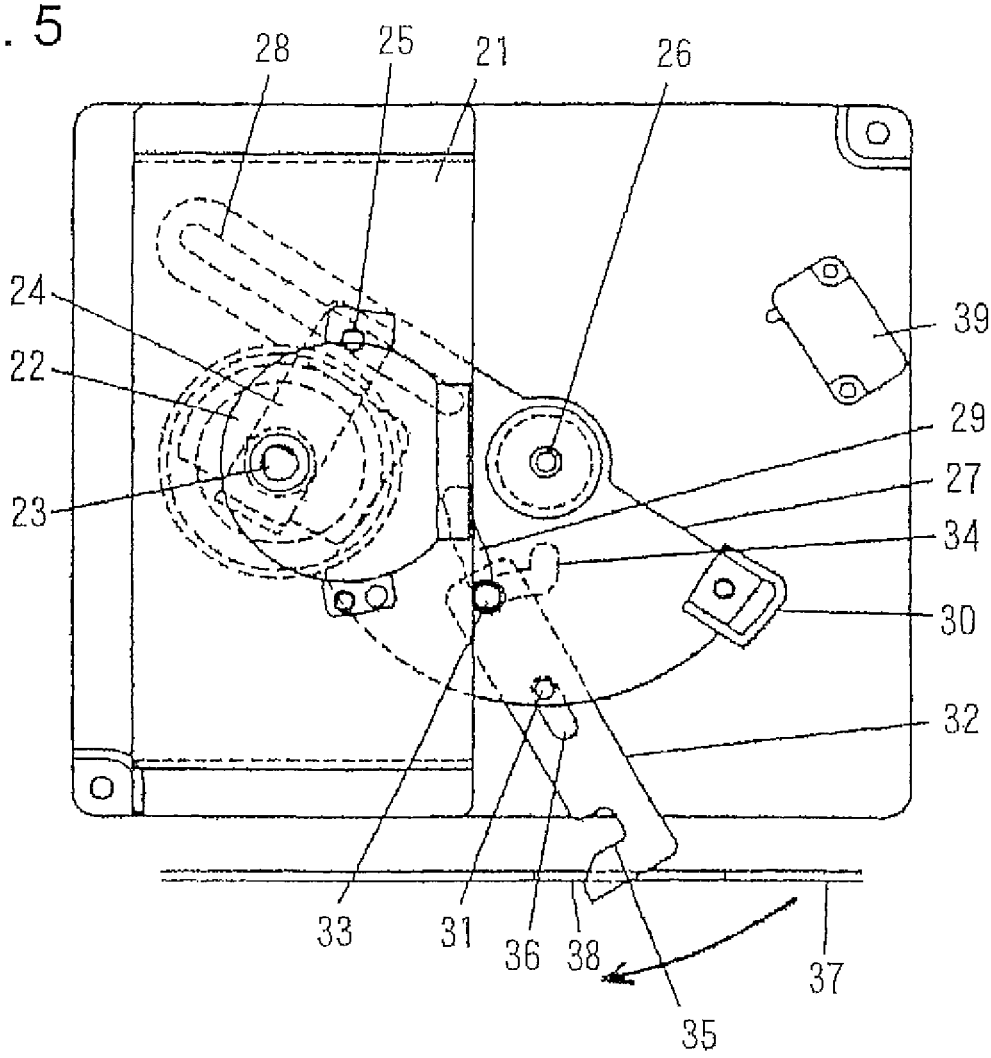
FIG. 5 is a schematic view for illustrating door lock of a conventional heating cooker.

Hereinafter, embodiments of the drawer-type heating cooker according to the present invention are described based on the attached drawings. FIG. 3 is a perspective view of an embodiment of the drawer-type heating cooker according to the present invention with its opening and closing door closed; FIG. 4 is a perspective view of the drawer-type heating cooker shown in FIG. 3 with its opening and closing door opened.

As shown in FIGS. 3 and 4, the drawer-type heating cooker shown in FIG. 3 (hereinafter simply referred to as the "heating cooker") includes a cooker body 21, and a drawer body 22 that can be pulled out from the cooker body 21. Inside the cooker body 21, a heating chamber, which the drawer body 22 for placing a heated object to be cooked therein can enter, is formed. The inside of the heating chamber is surrounded by the right and left, upper and lower, and back walls, and on the front surface, an opening portion for pulling out/pushing the drawer body 22 from/into is formed.

The drawer body 22 is disposed in such a manner it can move within the cooker body 21 via slide mechanisms 24, which are described later, so that it is pulled out from the heating chamber of the cooker body 21 to the outside in the direction shown in the arrow, or conversely, it is confined to the heating chamber from the outside. The drawer body 22 includes an opening and closing door (hereinafter abbreviated as the "door") 22*a* for opening/closing the heating chamber, and a heating container 23, to which the door 22*a* is attached, for accommodating a heated object when the heated object is placed therein. The heating container 23 has a front plate connected to the door 22*a*, right and left side plates extending backward from the right and left sides of the front plate, a back plate connected to the side plates at their rear (back) sides, and a bottom plate connected to the side plates and the back plate, and has a container opening portion allowing a heated object to be put in or taken out at its upper portion. In the cooker body 21, a microwave generating device (not shown) is provided around the heating chamber, the microwave generating device including a magnetron that generates microwave and a wave guide tube that transmits the microwave generated by the magnetron. The microwave generated by the magnetron passes through the wave guide tube, and supplied from a power supply port into the heating chamber.

What is claimed is:

1. A door lock control device in a heating cooker comprising:

a cooker body having a heating chamber formed therein;

an open/close door that can close an opening of the heating chamber;

a drive motor that drives a lock member for alternately locking and unlocking the open/close door and switches between a lock position and an unlock position; and a circuit that supplies power to the drive motor, wherein the circuit comprises:

a motor control relay being turned on to lock or unlock the door when the drive motor is driven;

a detection switch that switches between a lock side and an unlock side according to the lock position and the unlock position occupied by the lock member respectively, and a lock detection and thermal switch portion that is connected in series on the lock side of the detection switch with a thermal switch that is opened when a temperature inside the heating chamber is equal to or higher than a predetermined temperature, and on the unlock side of the detection switch directly, and the lock side and the unlock side are joined thereafter, wherein the motor control relay and the lock detection and thermal switch portion are connected in series with a power supply line to the drive motor, respectively.

2. The door lock control device in a heating cooker according to claim 1, wherein the supply of power to the drive motor is interrupted when the detection switch is on the lock side, the temperature inside the heating cooker is the predetermined temperature or more, and the thermal switch is opened.

3. A door lock control device in a heating cooker, comprising:

a cooker body having a heating chamber formed therein;

an open/close door that can close an opening of the heating chamber;

a drive motor that drives a lock member for alternately locking and unlocking the open/close door and switches between a lock position and an unlock position; and a circuit that supplies power to the drive motor, wherein the circuit comprises:

a motor control relay being turned on to lock or unlock the door when the drive motor is driven;

a detection switch that switches between a lock side and an unlock side according to the lock position and the unlock position occupied by the lock member respectively, and a lock detection and thermal switch portion that is connected in series on the lock side of the detection switch with a thermal switch that is opened when a temperature inside the heating chamber is equal to or higher than a predetermined temperature, wherein the lock detection and thermal switch portion is provided in a relay power supply line that drives the power supply line to the drive motor via a relay.

4. The door lock control device in a heating cooker according to claim 3, wherein the supply of power to the drive motor is interrupted when the detection switch is on the lock side, the temperature inside the heating cooker is the predetermined temperature or more, and the thermal switch is opened.

* * * * *